US006357606B1

(12) United States Patent
Henry

(10) Patent No.: US 6,357,606 B1
(45) Date of Patent: Mar. 19, 2002

(54) MODULAR SELF-ADJUSTING MERCHANDISE DISPLAY SYSTEM

(75) Inventor: Eric F. Henry, Rutherford, NJ (US)

(73) Assignee: HMG Worldwide In-Store Marketing, Inc., New York, NY (US)

( * ) Notice: Subject to any disclaimer, the term of this patent is extended or adjusted under 35 U.S.C. 154(b) by 0 days.

(21) Appl. No.: 09/495,750

(22) Filed: Feb. 1, 2000

Related U.S. Application Data

(60) Provisional application No. 60/118,294, filed on Feb. 2, 1999.

(51) Int. Cl.[7] ..... A47F 1/04

(52) U.S. Cl. ..... 211/59.3; 211/184

(58) Field of Search ..... 211/59.2, 59.3, 211/175, 183, 184, 90.02, 90.04, 43, 51, 88.02, 128.1, 153; 312/61, 71, 42

(56) References Cited

U.S. PATENT DOCUMENTS

| | | | | | |
|---|---|---|---|---|---|
| 2,652,154 | A | * | 9/1953 | Stevens | 211/59.3 |
| 3,308,961 | A | | 3/1967 | Chesley | 211/49 |
| 3,452,899 | A | | 7/1969 | Libberton | 221/242 |
| 4,300,693 | A | | 11/1981 | Spamer | 211/49 |
| 4,303,162 | A | | 12/1981 | Suttles | 211/49 |
| 4,460,096 | A | * | 7/1984 | Ricci | 211/184 |
| 4,503,982 | A | * | 3/1985 | Lewis | 211/184 |
| 4,615,276 | A | | 10/1986 | Garabedian | 211/184 |
| 4,685,574 | A | * | 8/1987 | Young et al. | 211/59.2 |
| 4,724,968 | A | * | 2/1988 | Wombacher | 211/59.3 |
| 4,730,741 | A | | 3/1988 | Jackle, III et al. | 211/59.3 |
| 4,801,025 | A | * | 1/1989 | Flum et al. | 211/59.2 |
| 4,830,201 | A | | 5/1989 | Breslow | 211/184 |
| 4,901,869 | A | | 2/1990 | Hawkinson et al. | 211/59.3 |
| 4,907,707 | A | | 3/1990 | Crum | 211/59.3 |
| 5,012,936 | A | | 5/1991 | Crum | 211/59.3 |
| 5,050,748 | A | * | 9/1991 | Taub | 211/59.2 |
| 5,085,154 | A | * | 2/1992 | Merl | 211/184 |
| 5,111,942 | A | * | 5/1992 | Bernardin | 211/59.3 |
| 5,161,702 | A | | 11/1992 | Skalski | 211/59.3 |
| 5,190,186 | A | | 3/1993 | Yablans et al. | 221/124 |
| 5,265,738 | A | * | 11/1993 | Yablans et al. | 211/59.3 |
| 5,366,099 | A | * | 11/1994 | Schmid | 211/59.3 |
| 5,390,802 | A | | 2/1995 | Pappagallo et al. | 211/59.3 |
| 5,413,229 | A | | 5/1995 | Zuberbuhler et al. | 211/59.3 |
| 5,458,248 | A | * | 10/1995 | Alain | 211/175 |
| 5,469,976 | A | | 11/1995 | Burchell | 211/59.3 |
| 5,613,621 | A | | 3/1997 | Gervasi | 221/279 |
| 5,634,564 | A | * | 6/1997 | Spamer et al. | 211/59.3 |
| 5,638,963 | A | * | 6/1997 | Finnelly et al. | 211/59.3 |
| 5,743,428 | A | | 4/1998 | Rankin, VI | 221/6 |
| 5,788,090 | A | * | 8/1998 | Kajiwara | 211/59.2 |
| 6,041,720 | A | | 3/2000 | Hardy | 108/60 |
| 6,129,218 | A | | 10/2000 | Henry et al. | 211/59.3 |
| 6,131,981 | A | * | 10/2000 | Finley | 211/187 |
| 6,142,317 | A | * | 11/2000 | Merl | 211/59.3 |

FOREIGN PATENT DOCUMENTS

| | | | |
|---|---|---|---|
| DE | 2 232 398 | 1/1974 | A47F/7/00 |
| GB | 697994 | 10/1953 | |
| GB | 1082150 | 9/1967 | A47F/1/00 |
| GB | 2 027 339 | 2/1980 | A47F/1/12 |

* cited by examiner

*Primary Examiner*—Daniel P. Stodola
*Assistant Examiner*—Jennifer E. Novosad
(74) *Attorney, Agent, or Firm*—Cohen, Pontani, Lieberman & Pavane

(57) ABSTRACT

A modular merchandise display system that is adaptable to accommodate various size products and shelves on which it is implemented. The modular merchandise display system includes a plurality of product pushing assemblies that are selectively connected to each other using adjustable connection devices. The selective connection of the product pushing assemblies provides the user with the ability to vary the size and spacing between product pushing assemblies and thereby enable the accommodation of products of varying size within the same merchandise display system. A break off system is also implemented into the respective parts of the display system to enable the depth of the system to be altered to accommodate shelves of varying depth.

16 Claims, 8 Drawing Sheets

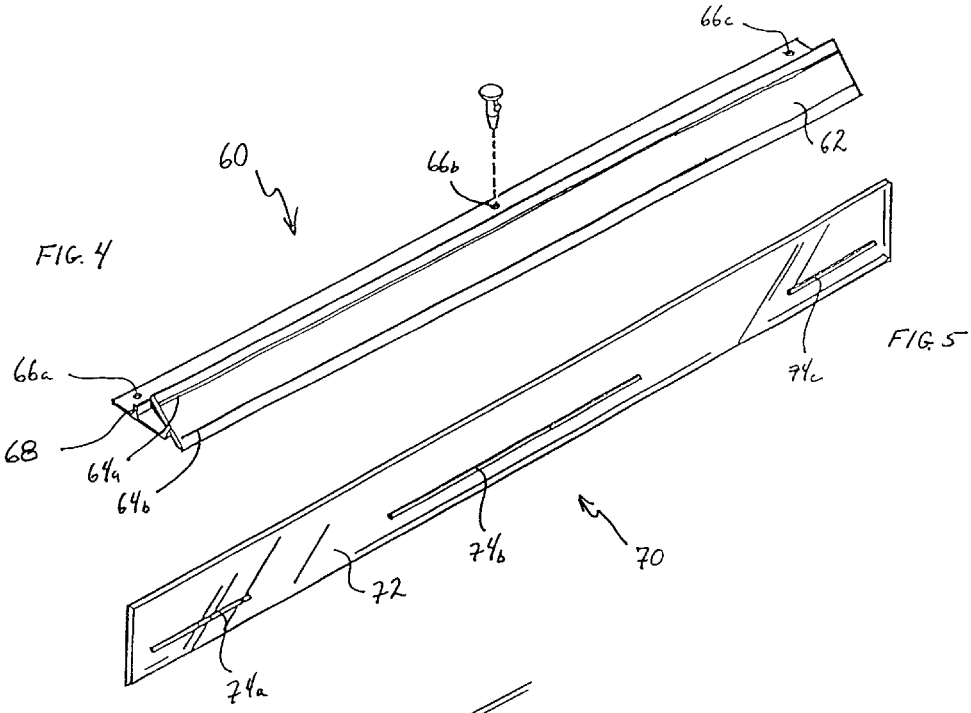
FIG. 4
FIG. 5
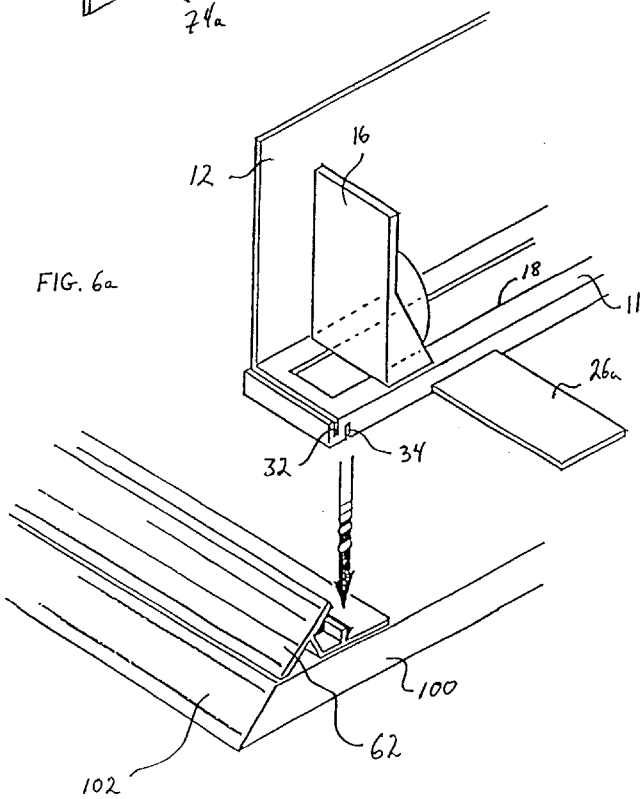
FIG. 6a
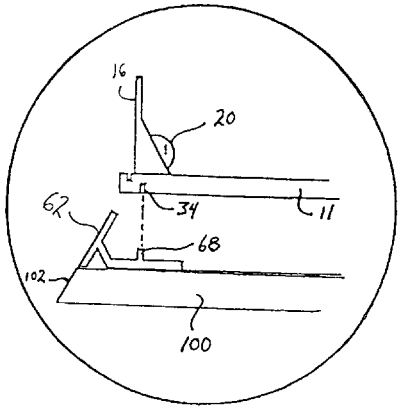
FIG. 6b

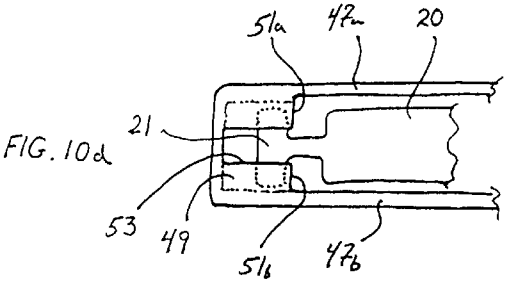
FIG. 10d
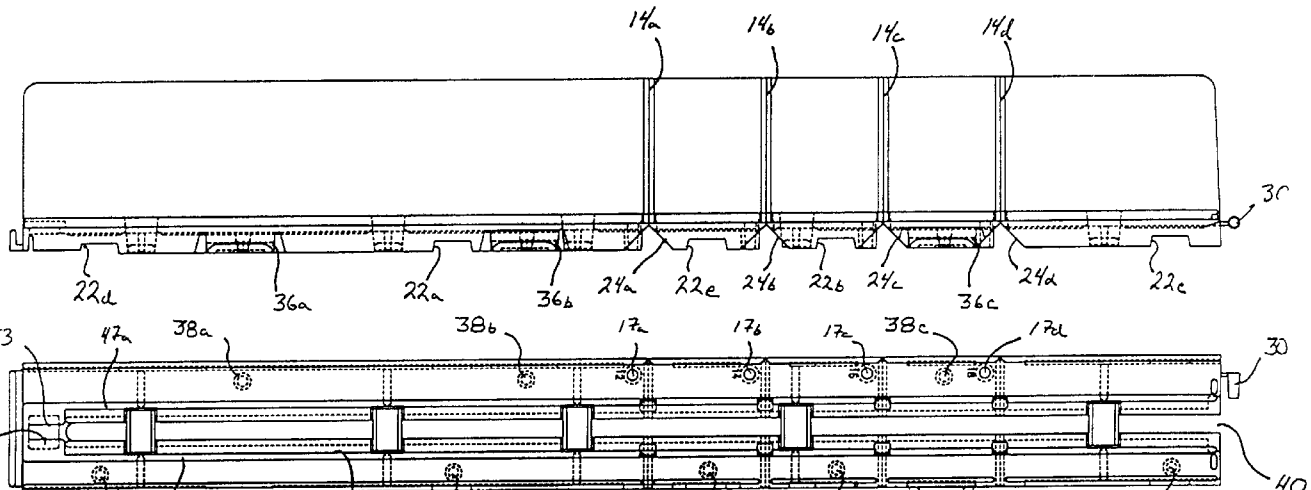
FIG. 10b
FIG. 10a
FIG. 10c

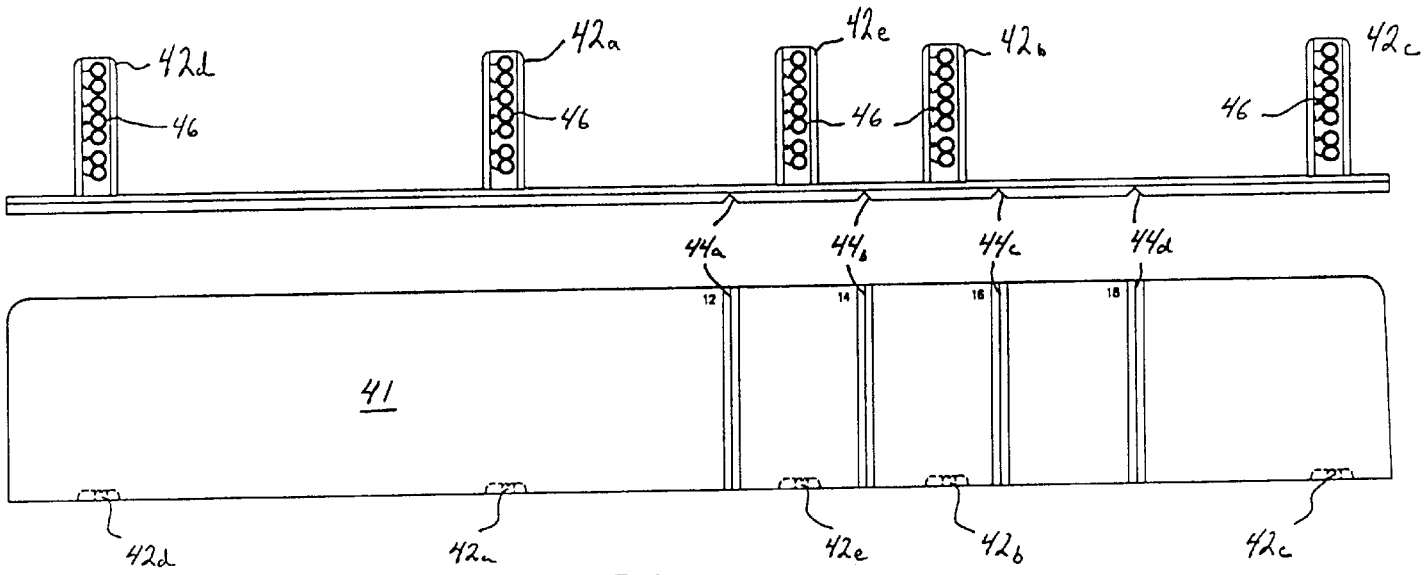
FIG. 12a
FIG. 12b
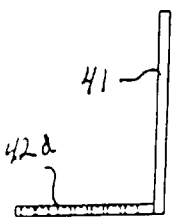
FIG. 12c

MODULAR SELF-ADJUSTING MERCHANDISE DISPLAY SYSTEM

This application claims the benefit of U.S. Provisional Application No. 60/118,294, filed Feb. 2, 1999.

BACKGROUND OF THE INVENTION

1. Field of the Invention

The present invention relates to a device for displaying serially stacked products, and more particularly to a device which automatically advances the products to one end of the display by means of at least one divider member with a spring-loaded pusher plate movably attached thereto.

2. Description of the Related Art

Merchandising practice requires that retail products be displayed in a well organized manner, and that merchandise be readily accessible and attractively displayed to the consumer. It is desirable that products stacked on a shelf be squarely aligned one behind the other, be oriented to face the consumer, be rotated to maintain freshness and be positioned so that the products are towards the front of the shelf. It is also desirable to display the products attractively thereby encouraging consumers to examine and purchase the merchandise.

In a typical wholesale or retail establishment serially stacked products are usually placed upon a shelf for display. Setting up and maintaining the display is usually done manually. The products must be carefully organized, rotated, stacked and aligned. The removal of merchandise by the consumer leaves a space at the front of the shelf with the remaining products towards the rear being difficult to view and access. Furthermore, the consumer is likely to move the products around so that the items are no longer neat and orderly but instead are haphazardly arranged, as a result of which many items no longer have the product name facing the front of the display. The merchandiser must continually inspect and rearrange the displayed products, which is time consuming and costly. It is therefore advantageous to have a display device which maintains stacked products in a neat and organized manner while automatically moving the merchandise toward the front as products are removed.

SUMMARY OF THE INVENTION

According to an embodiment of the present invention, the modular merchandise display system comprises at least one pusher tray assembly having a base tray or floor portion, a product pusher slidably disposed within an elongated slot in the base and biased in a direction toward the front of the tray via a tension spring, an integrated side panel (or divider wall) extending vertically upward from one of the sides of the base, and adjustment wings extending horizontally outward from the side of the tray opposing the side panel. The base includes an upper transverse slot in an upper side of the bottom adjacent the front of the pusher tray assembly, and a lower transverse slot in the underside of the bottom tray and spaced behind the upper slot.

The pusher tray assembly includes a plurality of transverse adjustment slots for receiving the adjustment wings of an adjacent pusher tray assembly. Protrusions extend into the adjustment slots from the underside of the bottom tray for engaging one of a plurality of alignment holes in the adjustment wings of the adjacent pusher tray assembly for securing adjacent pusher tray assemblies together and for allowing the spacing between dividers of adjacent pusher tray assemblies to be varied to accommodate products of varying sizes. The pusher tray assembly further comprises a plurality of end cap adjustment slots for receiving end cap adjustment wings on an end cap. Protrusions extending into the end cap adjustment slots from the bottom of the pusher tray assembly engage corresponding holes in the adjustment wings on the end cap for securing the end cap to an adjacent pusher tray assembly. The disposition of protrusions and alignment holes can be reversed without departing from the scope of this disclosure.

A front rail, preferably an extrusion, is mounted on the shelf for the display system, and includes an angled front face and an upwardly extending flange or protrusion. The flange engages the lower slot of one or more pusher tray assemblies for positioning the pusher tray assemblies with respect to the front rail. The end cap is secured to the last pusher tray assembly for enclosing the remaining open side thereof. The adjustment wings of the end cap are received by the end cap adjustment slots in the pusher tray, and engage the pin-like protrusions at the determined spacing for the product being displayed.

A front clear panel is slidably inserted into the upper slot of adjacently assembled pusher trays for preventing forward movement of the product so they are not pushed out of the display system by the product pushers. In an alternative embodiment, the front clear panel can be eliminated by providing the angled front face of the front rail with at least a transparent upper portion which would alternatively serve as the product stopper to prevent products from being pushed out of the display system. In this embodiment, the entire front face of the front rail could also be transparent, thus enabling the disposition of product description and price information either on or behind the clear angled front surface of the front rail.

The pusher tray assembly and the end cap are provided with break off points for enabling easy adjustment of the length of the respective pusher tray display system in accordance with the size of the shelf on which it is to be mounted. When the pusher tray assembly is shortened by breaking off the bottom and side panel along one of the break off points, a push (stop) pin is inserted in a corresponding hole in the bottom to prevent the product pusher from being pushed rearwardly beyond the shortened rear end on the assembly and becoming detached from the mounting slot in the bottom. The break off points provide a "one size fits all" configuration of the modular display system and thereby reduces the cost of manufacturing the same.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein:

FIG. 4 is a perspective view of the front rail according to an embodiment of the present invention;

FIG. 5 is a perspective view of the front window of the display system according to an embodiment of the present invention;

FIGS. 6*a* and 6*b* are construction views of the mating arrangement between the pusher tray assembly and the front rail according to an embodiment of the invention;

FIGS. 10*a–c* show a top, a right side and a front view, respectively, of the pusher tray assembly according to an embodiment of the present invention;

FIG. 10*d* is a view of the connection of a tension spring with the pusher tray assembly according to an embodiment of the present invention;

FIGS. 12*a,* 12*b* and 12*c* show a right side, a top and a front view, respectively, of the end cap according to an embodiment of the present invention.

DETAILED DESCRIPTION OF THE PRESENTLY PREFERRED EMBODIMENTS

Figure 1:
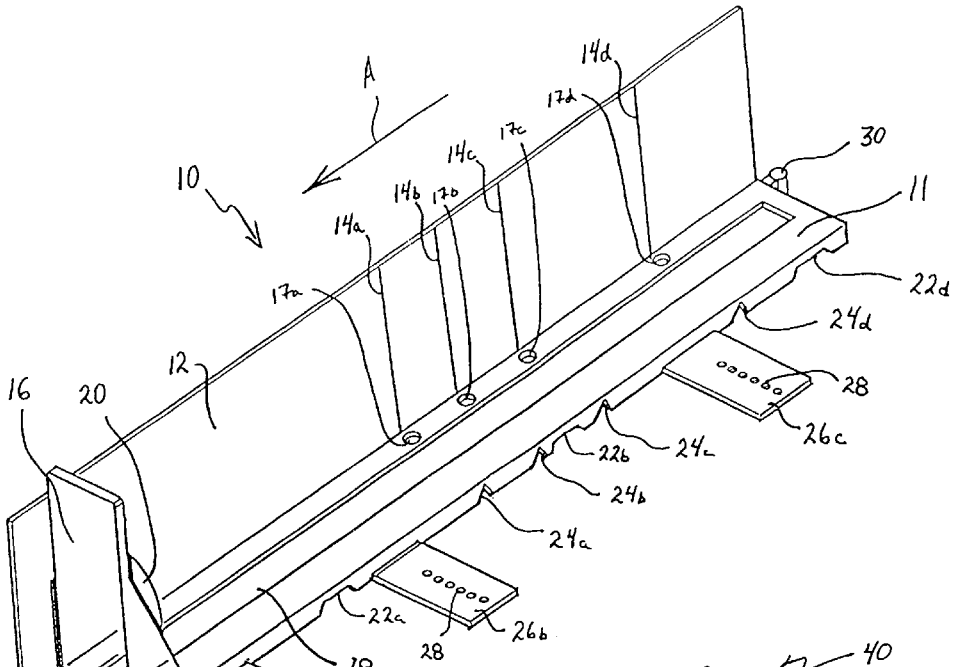
FIG. 1 is a perspective view of a modular pusher tray assembly according to an embodiment of the present invention.
Figure 2:
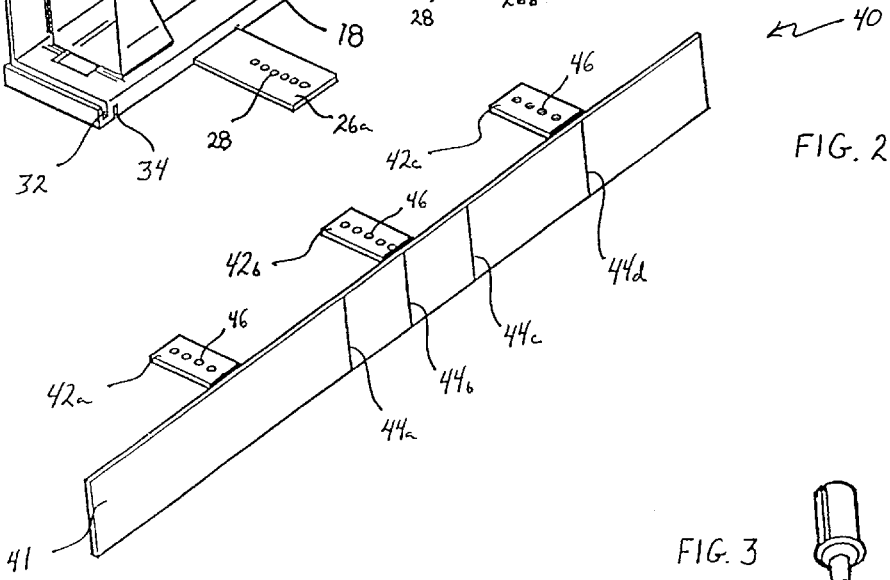
FIG. 2 is a perspective view of an end cap according to an embodiment of the present invention.
Figure 3:
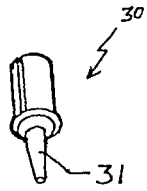
FIG. 3 is a perspective view of a push (stop) pin according to the invention.

Referring to FIG. 1, a modular pusher tray 10 has a bottom or floor 11, and an integrated side (divider) wall 12. The bottom 11 and the side wall 12 is preferably made of plastic, but may be made of metal, wood, or any other suitable material. The bottom 11 has an elongate slot 18 having a product pusher 16 slidably disposed therein. Pusher 16 is biased within slot 18 in a direction toward the front of tray 10 (indicated by arrow A) via a torsion spring 20. The bottom 11 and side panel 12 include break offs 24*a*–24*d* and 14*a*–14*d,* respectively, for enabling the length of the overall pusher tray 10 to be adjusted according to the depth of the display shelf on which it is to be disposed. Break offs 14*a*–14*d* and 24*a*–24*d* are formed by transverse indentations in the bottom 11 and side panel 12 such that upon bending these members about their respective break-off, the plastic will fatigue and, as a result, the respective side panel 12 or bottom 11 will be smoothly breakable along that line. The various dimensions for such break offs (14*a*–14*d,* and 24*a*–24*d*) are a matter of design choice, and can be, for example, 12", 14" 16" and 18", respectively, from the front of the pusher tray. When bottom 11 and side panel 12 are broken off at any of the respective break off points, a push (stop) pin 30 (FIG. 3) is inserted into the corresponding hole 17*a*–17*d* to prevent pusher 16 from being pushed rearward beyond the shortened end of tray 10 thereby disengaging the pusher 16 from slot 18. Stop pin 30 is shown in FIG. 3 and has a smaller insertion part 31 that is preferably has a reverse conical shape for enabling part 31 to frictionally engage holes 17*a*–17*d* as it is inserted into the same. As shown in FIG. 1, stop pin 30 can be integrally molded with bottom tray 11 during manufacturing and may be broken off when needed.

Figure 7:
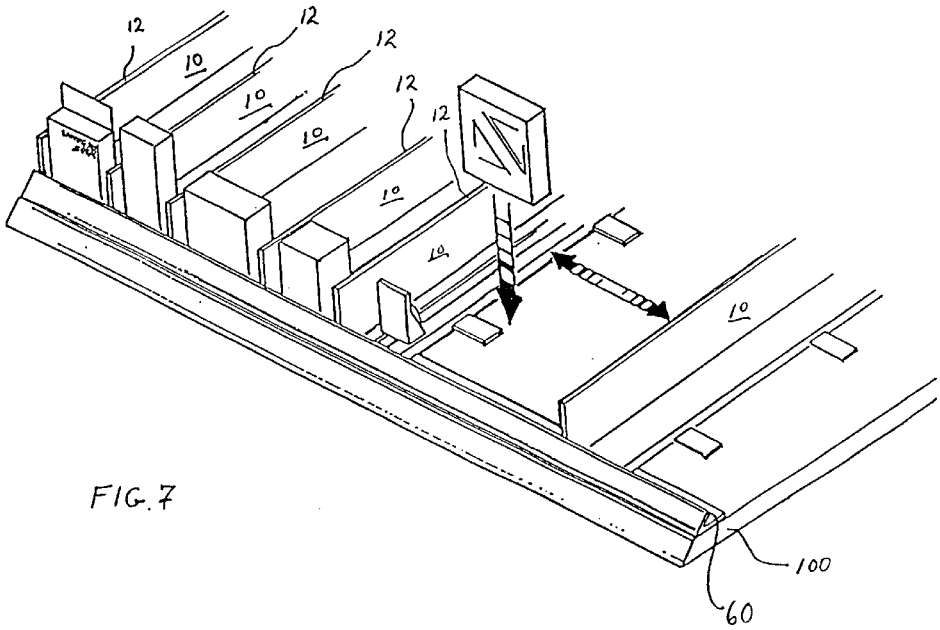
FIG. 7 is a perspective view of the modular pusher display system showing the accommodation of different size products.

Pusher tray 10 includes a plurality of adjustment wings 26*a*–26*c* each having a plurality of alignment holes 28. Bottom 11 includes a plurality of slots 36*a*–36*c* (FIGS. 10*a* and 10*b*) corresponding to the positions of the respective adjustment wings 26*a*–26*c* such that adjustment wings on one pusher tray 10 can be disposed in slots of an adjacent pusher tray 10. Pin-like projections 38*a*–38*c* (FIGS. 10*a* and 10*b*) extend into the respective slots 36*a*–36*c* from the underside of bottom 11. During operable positioning of each pusher tray 10, a particular alignment hole 28 of the adjustment wings 26*a*–26*c* engages the pin-like projections 38*a*–38*c* of the adjacent pusher tray so as to accommodate a particular size product between the respective side panels 12 of two adjacent modular pusher trays 10. FIG. 7 shows a plurality of modular pusher trays 10 arranged in side-by-side relation to each other, showing the distance between the side panels 12 is adjusted to accommodate products of different sizes. In an alternative embodiment, the pin-like projections 38*a*–38*c* are formed on the adjustment wings 26*a*–26*c* and replace alignment holes 28. Alignment holes 28 are then arranged in the slots 36*a*–36*c* such that the respective pin-like projection 38*a*–38*c* can engage alignment hole 28 to secure one pusher tray 10 to the adjacent pusher tray in a predetermined spacing according to the width of the product being displayed.

Figure 8:
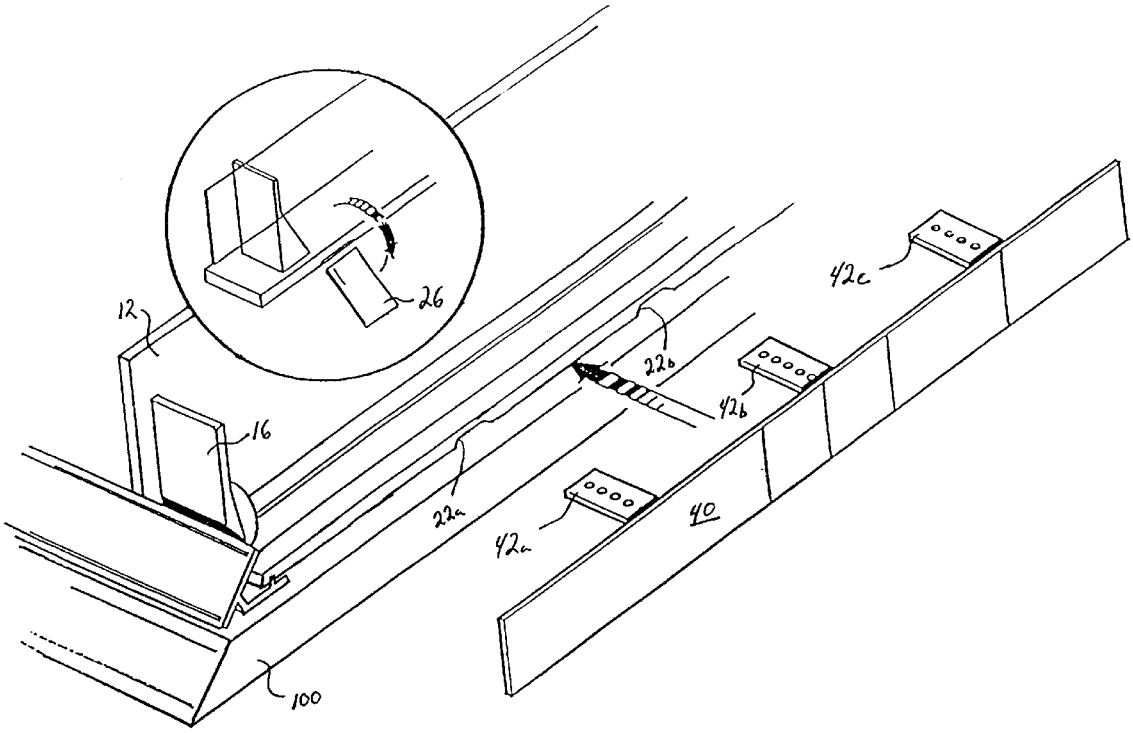
FIG. 8 is a construction view showing the disposition of the end cap according to an embodiment of the invention.

FIG. 2 and FIGS. 12*a*–12*c* show an end cap 40 having a right divider 41 according to the present invention. The end cap 40 is adapted to close the open side of the last modular pusher tray in a series of interconnected modular pusher trays 10 (See FIG. 8). End cap 40 has vertical side 41 having break offs 44*a*–44*d* corresponding in location to break offs 14*a*–14*d* and 24*a*–24*d*. End cap 40 also includes a plurality of adjustment wings 42*a*–42*e* each having a plurality of alignment holes 46. Bottom 11 includes a plurality of end cap slots 22*a*–22*e* for receiving the respective adjustment wings 42*a*–42*e*. Pin-like projections 23*a*–23*e* (FIG. 10*a*) extend into the end cap slots from the bottom 11 for engaging the alignment holes 46 in the respective adjustment wings 42*a*–42*e*. FIG. 8 shows an end cap 40 secured to the last modular pusher tray on a shelf 100. To secure end cap 40 to the last pusher tray 10, the adjustment wings 26*a*–26*c* of the last modular pusher tray 10 must be broken off (see detail view in FIG. 8) so as to not interfere with the positioning of end cap 40. In an alternative embodiment, a plurality of pin-like projections 23*a*–23*e* are formed on adjustment wings to replace alignment holes 46, and the alignment holes 46 are formed in the end cap slots 22*a*–22*e* in the underside of bottom 11.

FIG. 4 shows a shelf front rail 60 having mounting holes 66*a*–66*c* for mounting the same to a display shelf with screws, nuts and bolts, hook and loop fastener (VELCRO®) or the like. Front rail 60 can be made of plastic, polystyrene, polyvinylchloride, or any other suitable known material, and is preferably made by an extrusion process. Front rail 60 has an angled front face 62 having at elongated slots 64*a* and 64*b* for releasably receiving product description and or price information. Front rail 60 includes an upstanding flange 68 extending the length of the rail for engaging a lower slot 34 in bottom 11. FIGS. 6*a* and 6*b* show flange 68 received in slot 34 for positioning bottom 11 with respect to front rail 60 and for securing pusher tray 10 on shelf 100. The angled face 62 of front rail 60 is preferably positioned flush with an angled face 102 of shelf 100. The flush arrangement of angled face 62 with angled face 102 is not required for proper operation of the modular product pusher system according to the present invention, but rather serves to provide a clean finished look for the display system when mounted on a display shelf 100.

Figure 9:
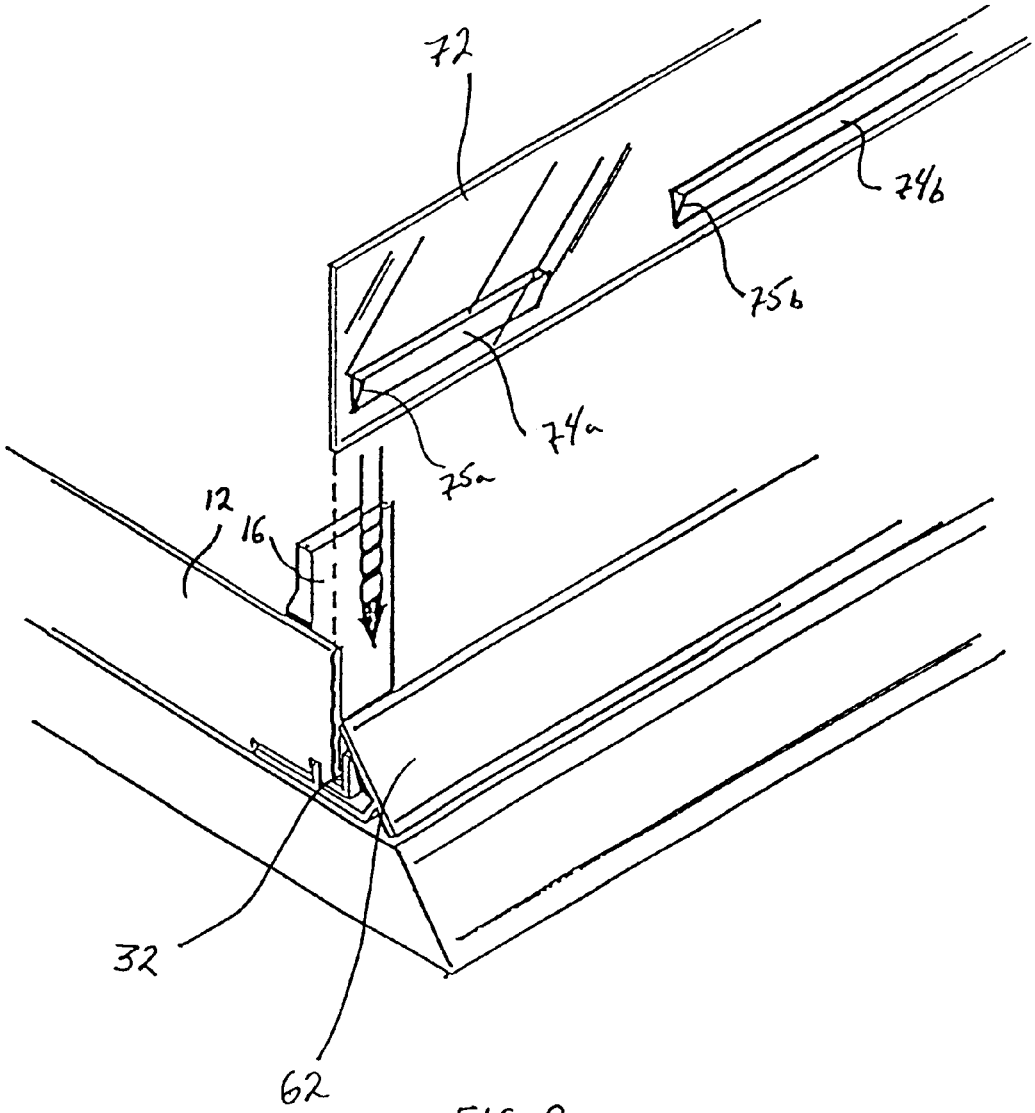
FIG. 9 is a construction view of the insertion of the front clear window according to the present invention.
Figures 13A, 13B, 13C:
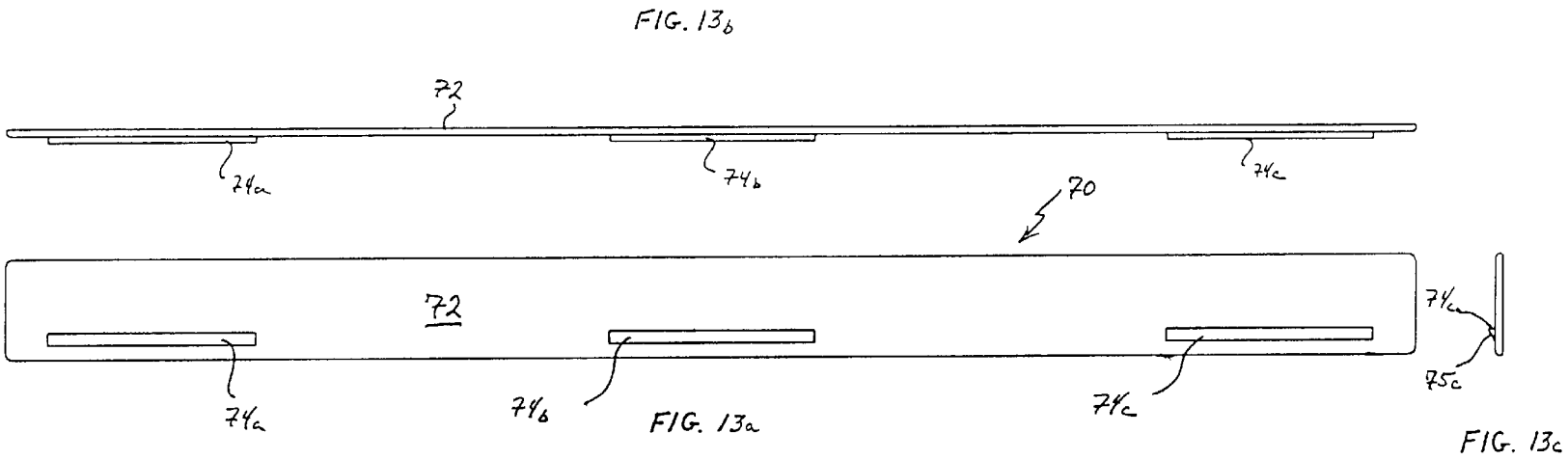
FIGS. 13*a,* 13*b* and 13*c* show a front, a top and a right side view, respectively, of a front window according to an embodiment of the present invention.

FIGS. 5 and 13*a*–13*c* show a clear front window or panel 70 having a front face 72 with ridges 74*a*–74*c* formed thereon. As best seen in FIGS. 9 and 13*c*, ridges 74*a*–74*c* are angled downward for deforming angle faces 75*a*–75*c*. As shown in FIG. 9, front window 70 is inserted into upper slots 32 in interconnected modular pusher trays 10 such that the angled ridges 74*a*–74*c* initially cause the upper end of front surface 62 of rail 60 to slightly deform outwardly as the ridges slide past the front surface 62. Once the tops of the ridges clear the top of the front surface 62, said surface returns to its original position and aides in preventing panel 70 from coming out of the slots 32. Once inserted, front window panel 70 acts as a product stopper to prevent the products being pushed forward by the respective pusher trays 10 from being pushed out of the front of the display.

In an alternative embodiment, front surface 62 of front rail 60 is transparent and can be formed to extend upward so as to replace the function of clear front window panel 70. This results in less parts to manufacture for the modular pusher tray assembly of the invention.

Figure 11C:
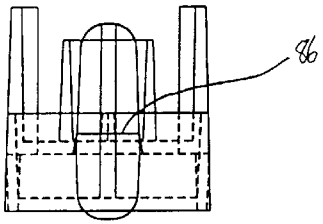
FIGS. 11*a,* 11*b* and 11*c* show a front, right side and a top view of the product pusher according to an embodiment of the present invention.
Figure 11B:
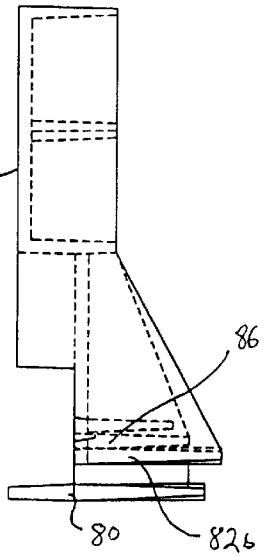
Figure 11A:
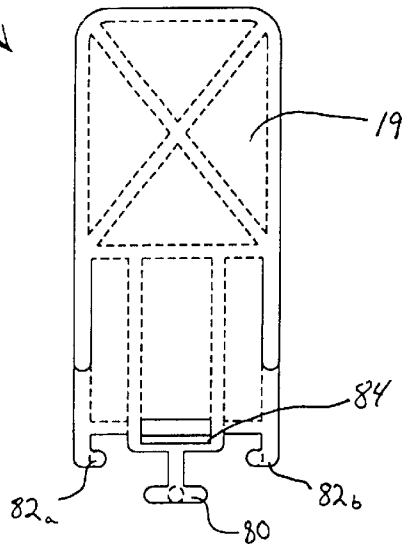

FIGS. 11*a*–11*c* show an embodiment of pusher 16 according to the invention. Pusher 16 has a bottom portion 80 that is slidably disposed in slot 18 in the bottom 11 (FIGS. 1 and 10*a*–10*c*). The outer lower flanges 82*a* and 82*b* slide on the upper surface of bottom 11, and are guided by respective rails 47*a* and 47*b* extending longitudinally along bottom 11. As best seen in FIGS. 10*a* and 10*d*, bottom 11 includes an area 49 on the underside thereof for receiving and securing an end of tension spring 20. As shown, tension spring 20 has a T-shaped end 21 that is inserted into area 49 from an opening 53 in the top of bottom 11. Once inserted, the T-shaped end 21 abuts against shoulders 51*a* and 51*b* defining a side of area 49. The remaining portion of tension spring 20 passes through an aperture 84 in pusher 16 and is coiled in an area 86 behind pusher 16. The front surface 19 of pusher 16 is preferably flat, but may be any suitable shape to engage and push product disposed in the pusher tray 10.

All parts described herein, with the exception of tension spring 20, can be manufactured using plastic and suitable molds. Certain parts have uniform cross-sections can be manufactured by extrusion. As described, the molding of a "one size fits all" modular pusher tray 10 substantially reduces the cost of manufacturing by eliminating the need for different size pusher trays for shelves of different depth.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

means for selectively connecting each of said base trays with an adjacent base tray, wherein said side wall of a first base tray acts as one side of the merchandise display system and the side wall of a second adjacent base tray is selectively spaced from said side wall of the first base tray so as to create a product receiving space between the respective side walls, wherein said connecting means enables the product receiving space between said side walls to be selectively changed such that products of different size may be supported and displayed by the modular merchandise display system, wherein said connecting means comprises at least one adjustment wing extending outwardly from one of said two opposing sides of each of said base trays, said at least one adjustment wing having a plurality of holes extending along a length of said adjustment wing; and at least one pin-like projection disposed on an underside of each of said plurality of base trays and positionally aligned with said adjustment wing such that said pin-like projection is engageable with one of said plurality of holes in the at least one adjustment wing of an adjacent base tray.

2. The modular merchandise display system in accordance with claim 1, further comprising means for shortening the depth of the merchandise display system to enable the merchandise display system to be disposed on shelves of varying depth.

3. The modular merchandise display system in accordance with claim 2, wherein said means for shortening comprises:

at least one break point positioned on said base tray;

at least one break point positioned on said side wall and aligned with said at least one break point of said base tray; and stopping means for limiting rearward movement of said product pushing assembly when said break points are used to shorten the depth of the modular merchandise display system.

4. The modular merchandise display system in accordance with claim 3, wherein said stopping means comprises:

at least one hole disposed in said base tray and positioned in front of a corresponding one of said break points in said base tray and in said side wall; and at least one push pin for inserting into said at least one hole for engaging and preventing the rearward movement of said product pushing assembly beyond the corresponding break point.

5. The modular merchandise display system in accordance with claim 1, further comprising front support means for supporting and preventing the products being displayed from being pushed out of the display system by said product pushing assembly.

6. The modular merchandise display system in accordance with claim 5, wherein said front support means comprises:

a lower slot disposed on an underside of said base tray and proximate said front end;

an upper slot disposed on an upper surface of said base tray and being proximate said front end;

a front rail having a lower portion for attaching said front rail to a shelf, a front angled face, and a flange extending upward from said lower portion and adapted to be received by said lower slot in said base tray; and a front panel having at least one ridge for engaging under said angled face of the front rail and providing a support barrier for preventing the products being displayed from being pushed out of the front end of said base tray.

7. The modular merchandise display of claim 1, wherein said at least one adjustment wing extends outwardly from the opposing side opposite the side at which said side wall is located.

8. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

means for selectively connecting each of said base trays with an adjacent base tray, wherein said side wall of a first base tray acts as one side of the merchandise display system and the side wall of a second adjacent base tray is selectively spaced from said side wall of the first base tray so as to create a product receiving space between the respective side walls, wherein said connecting means enables the product receiving space between said side walls to be selectively changed such that products of different size may be supported and displayed by the modular merchandise display system, and an end cap for enclosing and creating the product receiving space between the side wall of a last base tray in said plurality, said end cap having adjustable connection means for adjustably connecting to a last of said plurality of base trays and enabling the product receiving space to be defmed between said end cap and said side wall of the last base tray;

wherein said connecting means comprises at least one adjustment wing extending outwardly from one of said end cap and said last base tray, and having a plurality of holes extending along a length of said adjustment wing; and at least one pin-like projection disposed on an underside of the other of said end cap and said last base tray and positionally aligned with said at least one adjustment wing such that said at least one pin-like projection engages one of said plurality of holes in said at least one adjustment wing.

9. The modular merchandise display system in accordance with claim 8, further comprising means for shortening the depth of the merchandise display system to enable the merchandise display system to be disposed on shelves of varying depth.

10. The modular merchandise display system in accordance with claim 9, wherein said means for shortening comprises:

at least one break point positioned on said base tray;

at least one break point positioned on said side wall and aligned with said at least one break point of said base tray; and stopping means for limiting rearward movement of said product pushing assembly when said break points are used to shorten the depth of the modular merchandise display system.

11. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

means for selectively connecting each of said base trays with an adjacent base tray, wherein said side wall of a first base tray acts as one side of the merchandise display system and the side wall of a second adjacent base tray is selectively spaced from said side wall of the first base tray so as to create a product receiving space between the respective side walls, wherein said connecting means enables the product receiving space between said side walls to be selectively changed such that products of different size may be supported and displayed by the modular merchandise display system; and means for shortening the depth of the merchandise display system, comprising a base tray break point positioned on said base tray;

a side wall break point positioned on said side wall of said base tray and aligned with said base tray break point of said base tray; and stopping means for limiting rearward movement of said product pushing assembly when said base tray and side wall break points are used to shorten the depth of the modular merchandise display system, said stopping means comprising a hole disposed in one of said base tray and said side wall and positioned in front of said base tray and said side wall break points; and a push pin for inserting into said hole for preventing the rearward movement of said product pushing assembly beyond the base tray break point.

12. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system for disposition on a shelf;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

means for selectively connecting each of said base trays with an adjacent base tray, wherein said side wall of a first base tray acts as one side of the merchandise display system and the side wall of a second adjacent base tray is selectively spaced from said side wall of the first base tray so as to create a product receiving space between the respective side walls, wherein said connecting means enables the product receiving space between said side walls to be selectively changed such that products of different size may be supported and displayed by the modular merchandise display system; and front support means for supporting and preventing the products being displayed from being pushed out of the display system by said product pushing assembly, said front support means comprising a lower slot disposed on an underside of said base tray and proximate said front end, an upper slot disposed on an upper surface of said base tray and being proximate said front end, a front rail having a lower portion for attaching said front rail to the shelf, a front angled face, and a flange extending upward from said lower portion and adapted to be received by said lower slot in said base tray, and a front panel having at least one ridge for engaging under said angled face of the front rail and providing a support barrier for preventing the products being displayed from being pushed out of the front end of said base tray.

13. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

means for selectively connecting each of said base trays with an adjacent base tray, wherein said side wall of a first base tray acts as one side of the merchandise display system and the side wall of a second adjacent base tray is selectively spaced from said side wall of the first base tray so as to create a product receiving space between the respective side walls, wherein said connecting means enables the product receiving space between said side walls to be selectively changed such that products of different size may be supported and displayed by the modular merchandise display system, wherein said connecting means comprises at least one adjustment wing extending outwardly from a side of each said base tray, and means for engaging said adjustment wing, said engaging means being disposed on an underside of said adjacent base tray, said adjustment wing and engaging means cooperating with each other to provide adjustment of the product receiving space.

14. The modular merchandise display system in accordance with claim 13, wherein said means for selectively connecting comprises:

at least one adjustment wing extending outward from the side of said base tray opposite said side wall, said at least one adjustment wing having a plurality of holes extending along a length of said adjustment wing; and at least one pin-like projection disposed on an underside of said base tray and positionally aligned with said adjustment wing such that said pin-like projection engages one of said plurality of holes in the at least one adjustment wing of the adjacent base tray.

15. A modular merchandise display system comprising:

a plurality of base trays each having a front end, a rear end, two opposing sides extending between said front and rear ends, and an elongated slot extending from proximate said front end to proximate said rear end, said front and rear ends defining a depth of the modular merchandise display system;

a product pushing assembly slidably disposed in said elongated slot of each of said plurality of base trays, said pushing assembly being biased toward said front end of said base tray to automatically urge products being displayed toward said front end;

a side wall extending upward from one of said two opposing sides of each of said plurality of base trays, said side wall being arranged substantially perpendicular to said base tray;

said base trays in said plurality being disposed adjacent to each other on said shelf so that said side wall of a first base tray and said side wall of an adjacent base tray are selectively spaced from each other to create a product receiving space therebetween, each of said base trays including an adjustment wing extending outwardly from a base tray side, and an engagement region disposed on an underside of said base trays so that said adjustment wing of said first base tray engages said engagement region of said adjacent base tray, said adjustment wing and engagement region cooperating with each other to provide adjustment of the product receiving space.

16. A base tray module for use in a modular merchandise display system, comprising:

a base tray having a front end, a rear end, two opposing sides extending between said front and rear ends, and an elongated slot extending from proximate said front end to proximate said rear end, said front and rear ends defining a depth of the modular merchandise display system for disposition on a shelf;

a product pushing assembly slidably disposed in said elongated slot of said base tray, said pushing assembly being biased toward said front end of said base tray to automatically urge products being displayed toward said front end;

a side wall extending upward from one of said two opposing sides of said base tray, said side wall being arranged substantially perpendicular to said base tray; and an adjustment wing extending outwardly from one of said base tray sides, and an engagement region disposed on an underside of said base tray so that said adjustment wing of said base tray engages an engagement region of an adjacent base tray having an adjacent base tray side wall for forming a product receiving space between said side wall of said base tray and said side wall of said adjacent base tray, said adjustment wing and engagement region cooperating with each other to provide adjustment of the product receiving space.

* * * * *